United States Patent [19]

Asano et al.

[11] 4,314,537

[45] Feb. 9, 1982

[54] FUEL FEEDBACK CONTROL SYSTEM FOR INTERNAL COMBUSTION ENGINE

[75] Inventors: Masaharu Asano, Yokosuka; Hideyuki Tamura, Yokohama; Shoji Furuhashi, Kami-ohokanishi, all of Japan

[73] Assignee: Nissan Motor Co., Ltd., Yokohama, Japan

[21] Appl. No.: 140,666

[22] Filed: Apr. 15, 1980

[30] Foreign Application Priority Data

Apr. 16, 1979 [JP] Japan ..... 54-45326

[51] Int. Cl.[3] ..... F02B 33/00; F02M 7/00; F02B 75/10; F02D 3/04

[52] U.S. Cl. ..... 123/440; 123/480; 123/489; 123/437; 123/438

[58] Field of Search ..... 123/440, 437, 438, 478, 123/480, 489

[56] References Cited

U.S. PATENT DOCUMENTS

| | | | |
|---|---|---|---|
| 4,106,450 | 8/1978 | Norimatsu et al. | 123/440 |
| 4,132,200 | 1/1979 | Asano et al. | 123/440 |
| 4,140,086 | 2/1979 | Schnurle et al. | 123/440 |
| 4,144,847 | 3/1979 | Hosaka | 123/440 |
| 4,153,023 | 5/1979 | Asano et al. | 123/440 |
| 4,155,335 | 5/1979 | Hosaka et al. | 123/440 |
| 4,167,925 | 9/1979 | Hosaka et al. | 123/440 |
| 4,214,563 | 7/1980 | Hosaka | 123/440 |
| 4,226,221 | 10/1980 | Asano | 123/440 |
| 4,237,829 | 12/1980 | Asano et al. | 123/440 |
| 4,240,389 | 12/1980 | Shimazaki | 123/440 |

*Primary Examiner*—R. A. Nelli

*Attorney, Agent, or Firm*—Schwartz, Jeffery, Schwaab, Mack, Blumenthal & Koch

[57] ABSTRACT

A system for controlling in a feedback control mode the air-fuel ratio of an air-fuel mixture to be supplied to an internal combustion engine in response to the deviation from a reference value, of an output of an exhaust sensor for sensing the concentration of a component of engine exhaust gas. The reference value is varied even during stopping of the feedback control due to an lowered engine temperature, thereby preventing an erroneous control. Additionally, the reference value and the value of a current flow to the exhaust sensor are varied immediately when the feedback control is stopped due to lowering in the engine temperature, thereby quickening the initiation of the feedback control.

14 Claims, 15 Drawing Figures

FUEL FEEDBACK CONTROL SYSTEM FOR INTERNAL COMBUSTION ENGINE

This invention relates in general to a system for controlling in a feedback control mode fuel supply to an internal combustion engine in response to a signal from an exhaust sensor for sensing the concentration of an exhaust gas component, and more particularly to a measure, in the system, for achieving precise and appropriate feedback control of the air-fuel ratio of an air-fuel mixture to be supplied to the engine.

A main object of the present invention is to provide an improved fuel feedback control system for an internal combustion engine, which can control precisely and appropriately the air-fuel ratio of an air-fuel mixture to be supplied to an internal combustion engine at a preset value, achieving a quickening in the initiation of the feedback control of the air-fuel ratio and an extreme reduction in the danger of producing an erroneous control.

Another object of the present invention is to provide an improved fuel feedback control system for an internal combustion engine which causes a normal feedback control to be initiated without producing an erroneous control range immediately when an engine temperature reaches a predetermined level, and detects the warm-up condition of an exhaust sensor immediately when the feedback control is stopped.

A further object of the present invention is to provide an improved fuel feedback control system for an internal combustion engine, in which a reference value with which an output of an exhaust sensor is compared is varied even when the feedback control is stopped due to a low engine temperature, and the reference value and the value of a current flow to be supplied to an exhaust sensor are varied.

Other objects, features and advantages of the improved fuel feedback control system according to the present invention will be more apparent from the following description taken in conjunction with the accompanying drawings wherein the same reference numerals designate the same parts and elements throughout all the drawings, in which.

In connection with an exhaust emission control in an automotive vehicle, a fuel feedback control system has recently been put into practical use in which the fuel amount to be supplied to an engine is controlled in response to an indication of the concentration of a component of exhaust gas from the engine so as to control the air-fuel ratio of a mixture supplied to the engine.

Figure 1:
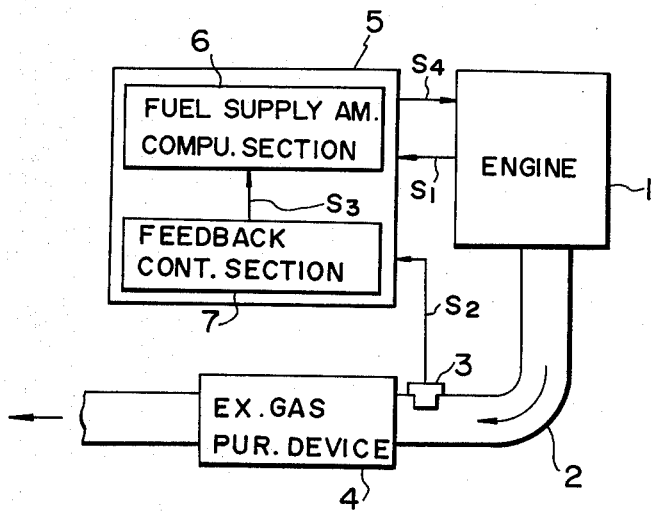
FIG. 1 is a block diagram of a fuel feedback control system to which the present invention is applicable, in cooperation with an internal combustion engine.

An example of such a fuel feedback control system will be shown in FIG. 1 in which an internal combustion engine 1, for example, of an automotive vehicle (not shown) is provided with an exhaust pipe 2. An exhaust gas sensor 3 is disposed in the exhaust pipe to sense the concentration of a component of exhaust gas passing through the exhaust pipe 2. An exhaust gas purifying device 4 is disposed in the exhaust pipe 2 to purify the exhaust gas to be discharged to ambient air. The reference numeral 5 denotes a control unit which comprises a fuel supply amount computing section 6 and a feedback control section 7. The control unit 5 is constituted, for example, by a microcomputer. The exhaust gas sensor 3 produces a signal $S_2$ corresponding, for example, to an oxygen concentration in the exhaust gases passing through the exhaust pipe 2.

The feedback control section 7 is constructed and arranged to determine whether the air-fuel ratio of the mixture is higher or lower than a preset value, i.e., whether the air-fuel mixture is lean or rich, in response to the signal $S_2$, and then to produce a control signal $S_3$ to increase fuel supply amount when the mixture is over-lean and to decrease the fuel supply amount when the mixture is over-rich. The fuel supply amount computing section 6 is constructed and arranged to compute a basic value of fuel supply amount in response to an engine operating condition signal $S_1$ (representing intake air amount, engine speed, engine temperature etc.) and then to compute an actual fuel supply amount by correcting the basic value in accordance with the above-mentioned control signal $S_3$ to produce a fuel supply amount signal $S_4$. This fuel supply amount signal $S_4$ controls a fuel supply device, for example, a fuel injection device or an electronically controlled carburetor in the engine 1, by which the engine is supplied with fuel in an amount corresponding to an engine operating condition so that the air-fuel ratio of the mixture supplied to the engine is maintained at a desired value (referred hereinafter to as a preset air-fuel ratio). If the exhaust gas purifying device 4 is a so-called three-way catalytic converter functioning simultaneously to oxidize carbon monoxide (CO) and hydrocarbonds (HC) and to reduce nitrogen oxides ($NO_x$), the preset air-fuel ratio may be a value near stoichiometric air-fuel ratio (14.8:1).

Figure 2B:
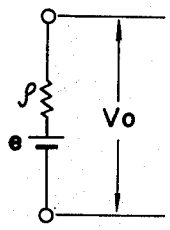
FIG. 2B is an electrical equivalent circuit of the exhaust sensor of FIG. 2A.
Figure 3:
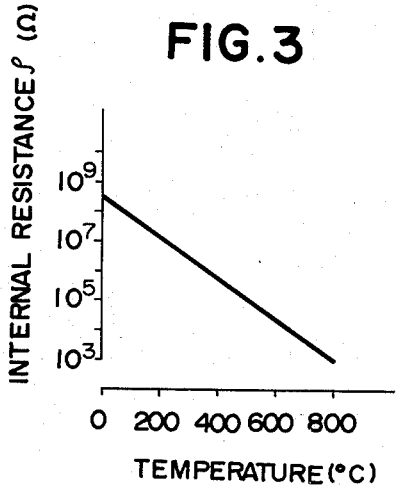
FIG. 3 is a graph showing the temperature characteristics of the exhaust sensor of FIG. 2A.

The exhaust gas sensor 3 used for the above-mentioned air-fuel ratio control usually varies in its characteristics in accordance with temperature of atmosphere sorrounding the exhaust gas sensor 3. There is a zirconia oxygen concentration detector which is usually used as the exhaust sensor and its electrical equivalent circuit is shown in FIG. 2B which circuit is constructed by a parallel circuit of a cell whose electromotive force varies in accordance with oxygen concentration and an internal resistance whose resistance value varies in accordance with the temperature of the sensor. Since the value of the internal resistance has temperature characteristics as shown in FIG. 3, the value becomes high at a low temperature and accordingly it becomes difficult to effectively pick up an electromotive force. Hence, it is necessary to control, in a so-called open loop mode, the air-fuel ratio of the mixture to be supplied to the engine at a low temperature of the exhaust gas sensor so as to usually maintain a constant state of air-fuel ratio, and only to control it in a so-called closed loop mode (a feedback control mode) when the temperature of the exhaust sensor reaches a certain level sufficient to operate the exhaust gas sensor.

One of the methods for measuring the temperature of the exhaust sensor is to detect a voltage variation caused by the variation of the internal resistance value due to temperature variation. The voltage variation can be detected by way of supplying a current flow into the exhaust sensor from the outside. In other words, when a constant current flow is supplied to the exhaust sensor from the outside, the output voltage $V_o$ of the exhaust sensor is as follows:

$$V_o = e + \rho i \quad (1)$$

As apparent from the above equation, when the value decreases with a rise in temperature, the value $V_o$ is also lowered. Accordingly, it is suitable to begin the closed loop control of the air-fuel ratio when the value $V_o$ becomes lower than a predetermined level.

It is known to be advantageous to vary a reference value $V_s$ for determining whether the air-fuel ratio is higher or lower from the signal $S_2$ of the exhaust sensor, as compared with the case in which the reference value is kept constant, for the purpose of effectively compensating the output variation of the exhaust sensor due to lower temperature, performance deterioration etc. In connection with the above-mentioned reference value $V_s$, the air-fuel ratio is, for example, determined to be lower than a preset air-fuel ratio when $S_2 > V_s$, and to be higher than the preset air-fuel ratio when $S_2 < V_s$.

A method for varying the reference value $V_s$ in accordance with the output condition of the exhaust sensor is, for example, to set as the reference value $V_s$ the average of the maximum value (the value at over-rich air-fuel mixture) and the minimum value (the value at over-lean air-fuel mixture) of the exhaust sensor output. Additionally, the relationship between the output voltage $V_o$ of the exhaust sensor and the reference value $V_s$ is employed to determine whether the exhaust sensor is in an active condition, i.e., in a condition where the exhaust sensor can normally operate. In other words, at a low temperature, the internal resistance of the exhaust sensor is higher, so that the output voltage $V_o$ becomes higher when a current flow is supplied to the exhaust sensor from the outside. Therefore, if a condition of $V_o > V_s$ continues exceeding a predetermined time period (referred hereinafter to as a monitor time), the exhaust sensor is determined to be inactive, so that the feedback control of the air-fuel ratio is stopped. On the contrary, if the exhaust sensor is in the active condition, the value $V_o$ repeats two conditions, i.e., $V_o > V_s$ and $V_o < V_s$, alternately in response to the air-fuel ratio of the mixture to be supplied to the engine. Accordingly, if the condition is turned to $V_o < V_s$ during stopping of the feedback control (at which the condition is $V_o > V_s$), the exhaust sensor is in the active condition, so that the feedback control is initiated.

Now, when the temperature of the engine is low, for example, during cold starting of the engine, it is necessary to enrich the air-fuel mixture so that the air-fuel mixture becomes lower than the present air-fuel ratio, in order to obtain stable engine running. In this regard, the feedback control of the air-fuel mixture is stopped and a rich air-fuel mixture is supplied to the engine by the open loop control mode when the engine temperature is low, for example, below 10° C.

As mentioned above, the stopping of the feedback control in the fuel feedback control system is accomplished in response both to the warm-up condition of the exhaust sensor and the engine temperature condition. It is to be noted that the feedback control is stopped when at least one of the above-mentioned two conditions is realized.

However, with the afore-mentioned fuel feedback control system, the following problem unavoidably arises: The initiation of the feedback control is retarded, causing an erroneous control range to be used when the air-fuel ratio is controlled to be below a previous air-fuel ratio which is lower than the preset air-fuel ratio. This problem is based on the fact that the reference value $V_s$ is not varied during stopping of the feedback control due to a low engine temperature, and on the fact that the warm-up condition of the exhaust sensor is not detected (the reference value $V_s$ and the value of the current flow i are fixed) during the monitor time when the feedback control is stopped due to a drop in engine temperature.

In view of the above, the present invention contemplates overcoming the afore-mentioned problem encountered in the fuel feedback control system by arranging that the reference value $V_s$ is varied even during stopping of the feedback control due to lowered engine temperature, and additionally, the warm-up condition of the exhaust sensor is immediately detected by varying the current flow i and the reference value $V_s$ when the feedback control is stopped due to an engine temperature drop during the feedback control.

The manner of operation of the afore-mentioned fuel feedback control system will be hereinafter explained with reference to FIGS. 4, 5A, 5B and 5C, before a detailed explanation of the present invention.

Figure 4:
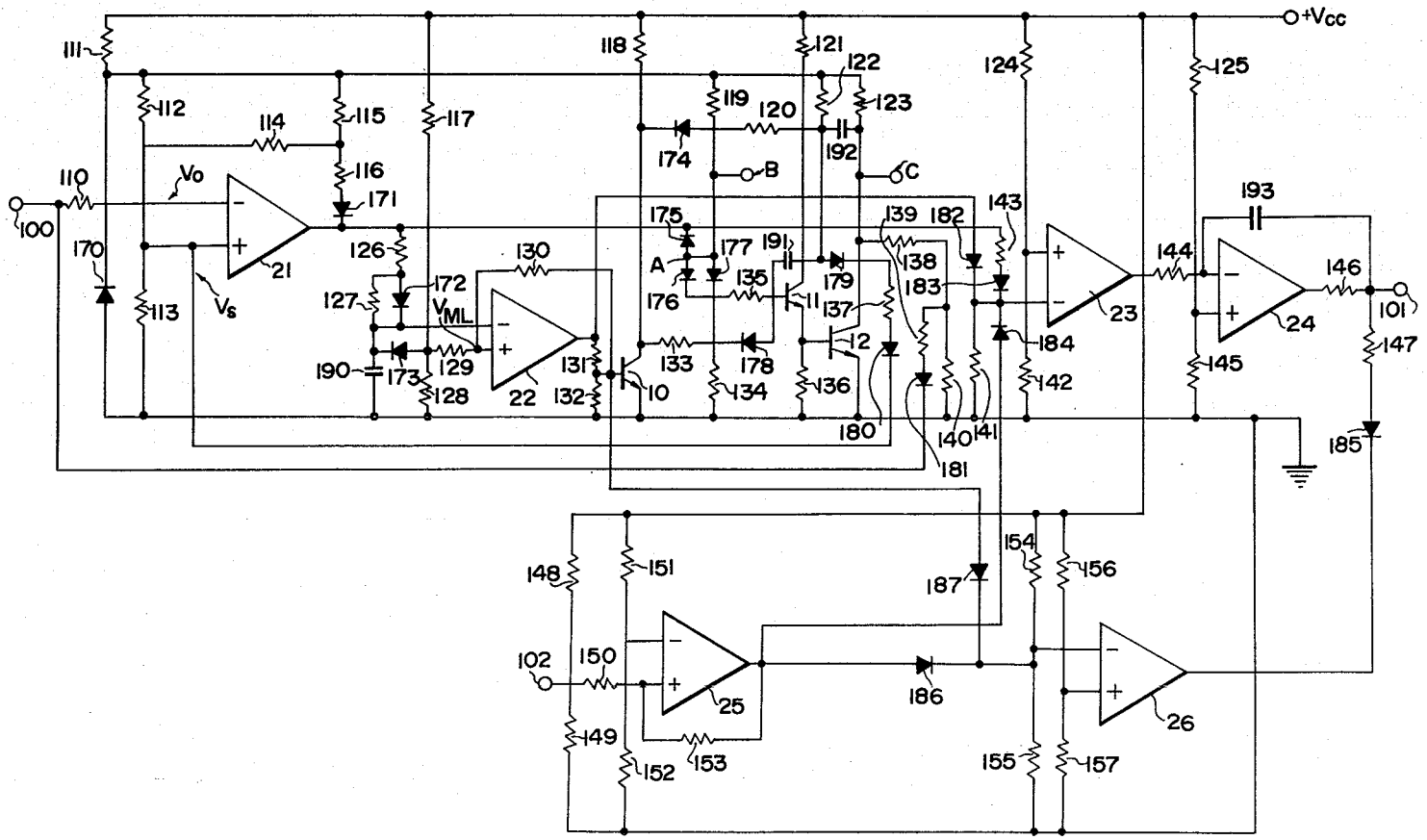
FIG. 4 is a circuit diagram of a feedback control section used in the system of FIG. 1.
Figure 5A:
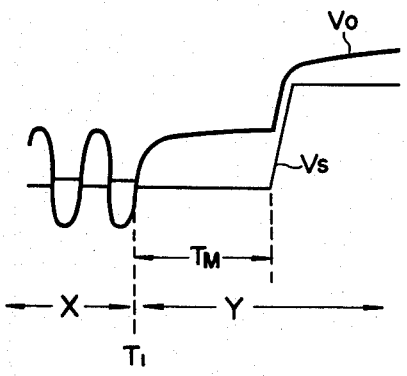
FIGS. 5A, 5B and 5C are graphical representations of signal wave forms generated in the circuit diagram of FIG. 4.
Figure 5B:
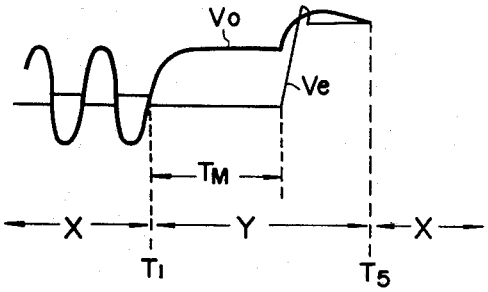
Figure 5C:
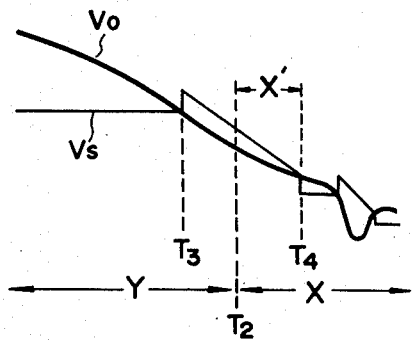

FIG. 4 shows a circuit diagram of the feedback control section 7 of FIG. 1, which section constitutes part of the fuel feedback control system. FIGS. 5A and 5B illustrate signal wave forms in the case of engine coolant temperature falling below the predetermined temperature (10° C.) at a time $T_1$. At this time, the feedback control period (X range) is changed to a feedback stopping period (Y range). In the Y range, the wave form in FIG. 5A is in the inactive condition and the wave form in FIG. 5B is in the active condition. On the contrary, FIG. 5C illustrates signal wave form in the case where the coolant temperature of the engine becomes higher than the predetermined level so that feedback control is initiated from the feedback stopping condition.

In FIG. 4, a signal ($S_2$ in FIG. 1, having a voltage $V_o$) from the exhaust sensor 3 is supplied to an input terminal 100 and a control signal ($S_3$ in FIG. 1) is produced at an output terminal 101. The output signal $V_o$ of the exhaust sensor is supplied to a comparator 21 so as to be compared with the reference voltage $V_s$. The output of the comparator 21 becomes a low level when $V_o > V_s$, and becomes a high level when $V_o < V_s$. Upon the high level of output of the comparator 21, since a capacitor 190 is rapidly charged through a diode 172, the terminal voltage of the capacitor 190 exceeds a predetermined level $V_{ML}$ which is decided by resistors 117 and 128, so that the output of the comparator 22 becomes a low level.

On the contrary, upon the low level of output of the comparator 21, the electric charge of the capacitor 190 is gradually discharged through resistors 126 and 127 so that the terminal voltage of the capacitor 190 becomes below the comparing level $V_{ML}$ after the lapse of a predetermined time period (referred hereinafter to as a monitor time $T_M$) which is determined by the values of the resistors 126 and 127 and the capacitor 190. This renders the output of the comparator 22 high.

The reference value $V_s$ and the output voltage $V_o$ of the exhaust sensor vary in response to the value of the current flow i to the exhaust sensor, supplied through a diode 180 and a diode 181, respectively. The value $V_s$ and value i are determined by an integrator which is constituted by transistors 11 and 12, a capacitor 191 etc. While the input of this integrator is the output of the comparators 21 and 22 in this case, the input may be pulse signal by which fuel injection is controlled when using an electronically controlled fuel injection system though not shown.

When the output of the comparator 22 is at a high level, a transistor 10 becomes conductive and accordingly the charge of a capacitor 191 is increased through a diode 178, so that the voltage at a point C rises. It will be understood that this operation is regardless of the output of the comparator 21.

When the output of the comparator 22 is at a low level, the transistor 10 becomes non-conductive or interrupted putting a diode 178 at an interrupted state, in which a diode 175 becomes conductive or non-conductive in response to the output of the comparator 21. In other words, upon the high level of the output of the comparator 21 the diode 175 becomes interrupted or non-conductive and the diode 176 becomes conductive and accordingly the voltage of a point B is supplied through the diode 176 to an integration circuit so that the voltage at a point C drops. Upon the low level of the output of the comparator 21, the diode 175 becomes conductive and the diode 176 becomes interrupted and accordingly the voltage at the point C does not vary.

When the voltage at the point C rises, diodes 180 and 181 become conductive, so that the values $V_s$ and $V_o$ rise. For example, when the output of the comparator 22 becomes at a high level after the monitor time $T_M$ in FIG. 5A lapses, the voltage at the point C rises as mentioned above so that the values $V_s$ and $V_o$ rise. As shown in FIG. 5C, the condition becomes $V_o<V_s$ at a time $T_3$ so that the output of the comparator 21 becomes at low level. As a result, the output of the comparator 22 becomes at a low level. Additionally, the fact that the condition $V_o>V_s$ is changed into the condition $V_o<V_s$ effects, in a feedback control mode the value $V_s$ through a resistor 114 and accordingly the value $V_s$ rises stepwise. This provides a hysteresis characteristic in the value $V_s$ for the purpose of preventing hunting of the engine. For the same purpose, the values $V_s$ vary stepwise also within feedback control ranges X in FIGS. 5A and 5B, in which the value $V_s$ descends when $V_o>V_s$ and ascends when $V_o<V_s$.

After the time $T_3$, the voltage at the point B is supplied through the diode 176 to the integration circuit and accordingly the voltage at the point C gradually drops. As a result, the values $V_s$ and $V_o$ also drop. Then, the condition becomes $V_o>V_s$ at a time $T_4$, so that the output of the comparator 21 becomes at a low level. At this moment, the value $V_s$ drops stepwise due to the above-mentioned hysteresis characteristic, and thereafter the voltage at the point C is maintained at a constant value until the condition becomes $V_o<V_s$ and accordingly the value $V_s$ is also maintained constant. The value $V_o$ varies in response to the variation of the air-fuel ratio of air-fuel mixture.

Now, connected to the minus input terminal of the comparator 23 are the output terminal of the comparator 21 (through a diode 183), the output terminal of the comparator 22 (through a diode 182), and the output terminal of the comparator 25 (through a diode 184).

When the output of the comparator 22 is at a low level, the output of the comparator 21 is supplied to the comparator 23 to be inverted and thereafter transmitted to an integrator 24 to produce a control signal having an integral characteristic, which control signal is transmitted from the output therminal 101.

Subsequently, when the output of the comparator 22 becomes at a high level, the output of the comparator 23 becomes at a low level regardless of the output of the comparator 21, so that the output of the integrator 24 rises. The output of the comparator 22 is supplied through the diode 187 also to a comparator 26. Accordingly, when the output of the comparator 22 becomes at a high level, the output of the comparator 26 becomes at a low level. As a result, the upper limit value of the voltage at the output terminal 101 is lowered. Since the saturated voltage of the integrator 24 is then lowered, the output of the integrator 24 reaches a saturated voltage and becomes constant. In other words, the feedback control of air-fuel ratio is stopped. This is a feedback stopping function in accordance with the warm-up condition of the exhaust sensor.

Now, a thermistor (not shown) is connected to an input terminal 102. The thermistor has a characteristic that its resistance value is lowered with temperature rise. This thermistor senses the temperature of an engine coolant. When the engine coolant temperature becomes below the predetermined level, for example 10° C., the output of the comparator 25 becomes at a high level. As a result, the outputs of the comparators 23 and 26 become at low levels and accordingly the feedback control of air-fuel ratio is stopped. This is a feedback stopping function in accordance with engine temperature or engine coolant temperature.

As apparent from the above, with the arrangement in FIG. 4, when the engine coolant temperature becomes below 10° C. during the feedback control of air-fuel ratio, (1) the feedback control is stopped, (2) the condition becomes $V_o>V_s$ since the fuel amount is increased because of low engine temperature in this case, (3) the reference voltage $V_s$ and the current flow i (accordingly $V_o$) are raised after the monitor time $T_M$ lapses, and (4) the reference voltage $V_s$ and the output voltage $V_o$ vary as indicated in FIG. 5A when the exhaust sensor is in the inactive condition and vary as indicated in FIG. 5B when the exhaust sensor is in the active condition.

Hence, in case when the coolant temperature becomes below 10° C. at the time $T_1$ and again becomes not lower than 10° C. between the times $T_1$ and $T_5$ the feedback control of air-fuel mixture is not initiated until the time $T_5$. In other words, the reopening of the feedback control is delayed by the monitor time $T_M$. This is disadvantageous for feedback control of air-fuel ratio of the mixture supplied to the engine.

In case of reopening the feedback control from a condition at which the feedback control is stopped at an engine coolant temperature below 10° C., the reference voltage $V_s$ and the output voltage $V_o$ vary as indicated in FIG. 5C. Hence, (a) since the fuel amount is increased for low temperature during stopping of the feedback control, the condition is $V_o > V_s$ is fixed. At a time at which the condition becomes $V_o < V_s$, the value of $V_s$ once rises stepwise and thereafter gradually drops. (b) In case where the coolant temperature becomes not lower than 10° C. at the time $T_2$, the feedback control is reopened at the time $T_2$. However, since the condition is $V_o < V_s$ from the time $T_2$ to the time $T_4$, the air-fuel ratio is controlled to further enrich the air-fuel mixture although the mixture is sufficiently rich. In this regard, a range X' is an erroneous control range. (c) The condition becomes $V_o > V_s$ at the time $T_4$ so as to carry out a normal control. As mentioned above, the erroneous control range may be caused in the fuel feedback control system explained hereinbefore.

In view of the above, the present invention is to solve the problems encountered in the afore-mentioned fuel feedback control system and it will be now explained in detail with reference to FIGS. 6, 7A, 7B and 7C.

Figure 6:
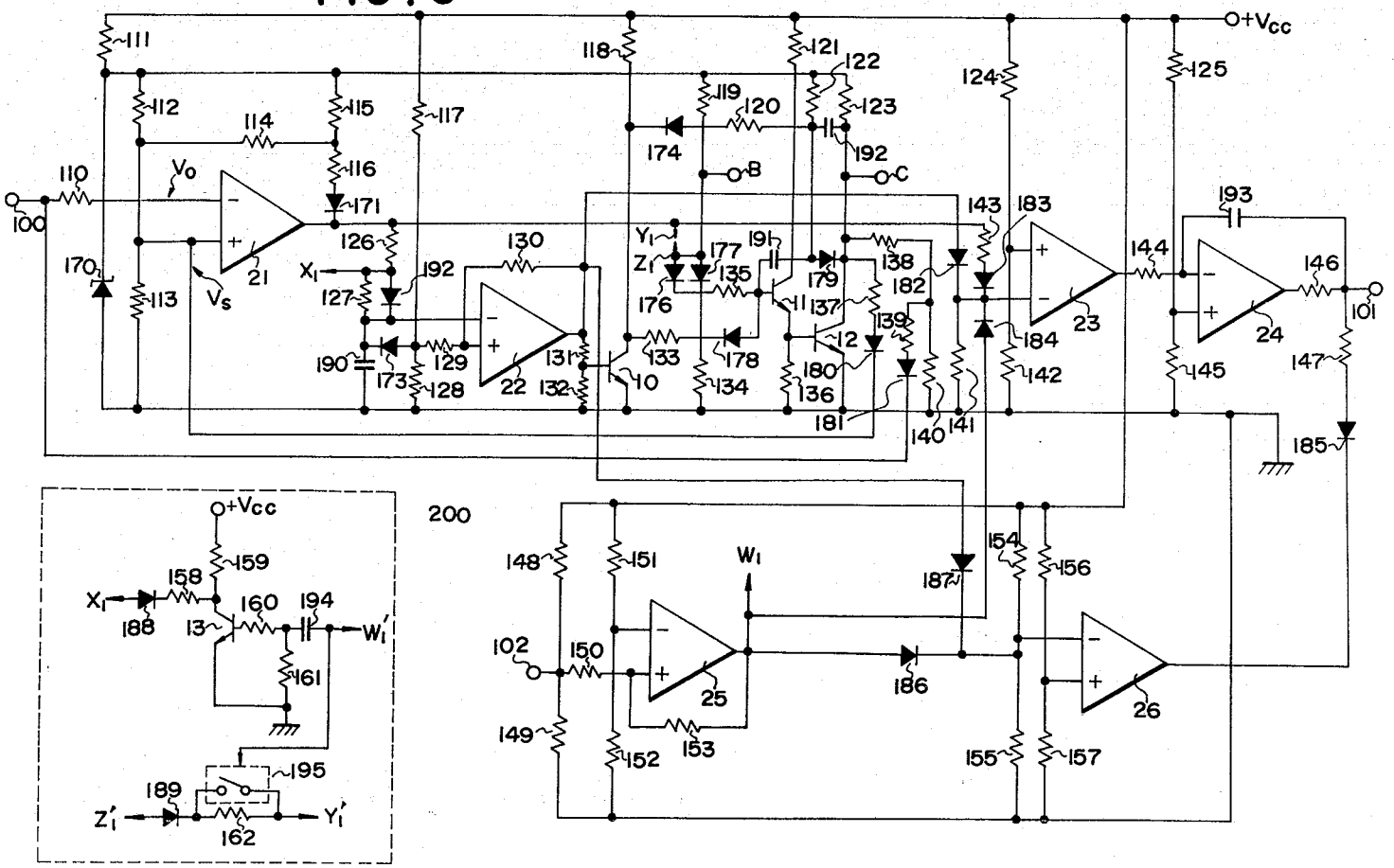
FIG. 6 is an example of a circuit diagram of a feedback control section according to the present invention, used in the system of FIG. 1.

FIG. 6 shows a circuit of an embodiment of the present invention which circuit is formed by adding a section 200 enclosed with a broken rectangular line to the circuit shown in FIG. 4, in which terminals $W_1$, $X_1$, $Y_1$ and $Z_1$ of the circuit are connected to the terminals $W'_1$, $X'_1$, $Y'_1$, and $Z'_1$ in the section enclosed with the broken line. The same reference numerals and symbols as in FIG. 4 designate the same part and elements in FIG. 6.

At first, when the engine coolant temperature becomes below 10° C. so that the output of the comparator 25 becomes at a high level, a transistor 13 becomes conductive for a predetermined time period by the effect of a differentiation circuit constituted by a capacitor 194 and a resistor 161. The charge of the capacitor 190 is discharged through diode 188 during the predetermined time period, by which the output of the comparator 22 becomes at a high level. Accordingly, when the coolant temperature becomes below 10° C., the output of the comparator 22 can be immediately made at a high level without the monitor time $T_M$.

In other words, the current flow is selected to bypass a resistance 162 or not to bypass the same by turning a switch 195 ON or OFF. When the stopping of the feedback control in accordance with coolant temperature is not carried out upon a coolant temperature not lower than 10° C., the output of the comparator 25 is at a low level. At this moment, the switch is turned ON and the voltage at the point C is maintained upon a low level of output of the comparator 21 since the connection of a diode 189 is the same as the diode 175 in FIG. 4 so as to operate in the same manner as the diode 175. Subsequently, when the stopping of the feedback control in accordance with coolant temperature is carried out due to a coolant temperature lower than 10° C., the output of the comparator 25 becomes at a high level and then the switch 195 is turned OFF, by which a resistor 162 becoming connected in series with the diode 189. When the output of the comparator 21 is at a high level, the diode 189 becomes non-conductive or interrupted like in FIG. 4 and accordingly the diode 176 becomes conductive so that the voltage at the point C gradually drops. When the output of the comparator 21 is at a low level, the voltage at the point B is divided through the resistor 162 and therefore the voltage dropping rate at the point C is decreased through the diode 176 becoming conductive. For reference, in the circuit of FIG. 4, the voltage at the point C is maintained at a constant level when the output of the comparator 21 is at a low level. However, it will be noted that, according to the present invention, the voltage at the point C gradually drops.

Hence, according to the present invention, in case wherein the stopping of feedback control in accordance with the warm-up condition of the exhaust sensor is not carried out (the exhaust sensor is in the active condition) and the stopping of the same only in accordance with the coolant temperature is carried out, the value $V_s$ is gradually lowered although the condition is $V_o > V_s$, i.e., the output of the comparator 21 is at a low level. Then, the feedback control is immediately initiated when the coolant temperature becomes not lower than 10° C., and thereafter the value $V_s$ varies like two steps, respectively having two kinds lowering inclinations, in response to the relationship between the values $V_s$ and $V_o$.

Figure 7A:
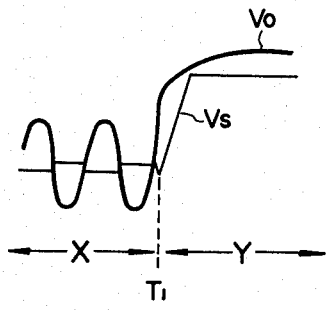
FIGS. 7A, 7B and 7C are graphical representations of signal wave forms generated in the circuit diagram of FIG. 6.
Figure 7B:
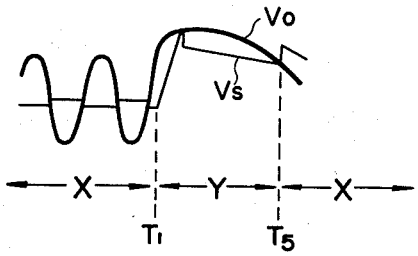
Figure 7C:
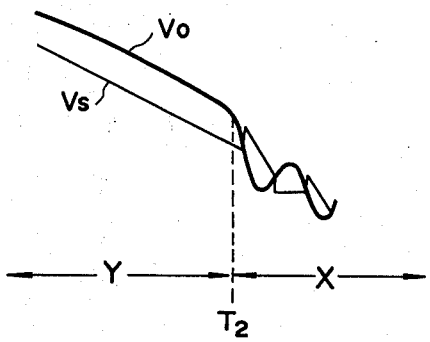

Therefore, with the circuit according to the present invention, as indicated in FIGS. 7A and 7B, when the coolant temperature becomes below 10° C., the feedback control is stopped and additionally the reference value $V_s$ and the current flow i (accordingly $V_o$) to the exhaust sensor are immediately raised. Consequently, as appreciated from the comparison between FIG. 5B and FIG. 7B, the initiation of the feedback control is quickened by the monitor time $T_M$. Furthermore, in the case wherein the feedback control is stopped due to the coolant temperature below 10° C., the reference value $V_s$ and the current flow i to the exhaust sensor are gradually dropped as indicated in FIG. 7C even when the condition is $V_o > V_s$. It is to be noted that the dropping rate during $V_o > V_s$ is smaller than in the case of $V_o < V_s$. In this regard, if the coolant temperature becomes not lower than 10° C. at a time $T_2$, the normal feedback control can be initiated at the time $T_2$ and therefore an erroneous control range like in FIG. 5C is not caused. It will be understood that FIGS. 5C and 7C illustrate the states in which the feedback control is reopened upon rise of coolant temperature after the stopping of feedback control due to lowering in coolant temperature have been continued.

During stopping of the feedback control due to lowering in coolant temperature, the warm-up of the exhaust sensor usually proceeds so that the internal resistance of the exhaust sensor decreases to lower the value $V_o$. As a result, as seen from FIG. 5C, the relationship between the magnitudes of the values $V_s$ and $V_o$ was reversed during stopping of the feedback control, and thereafter the erroneous control range was caused when the feedback control is reopened.

However, according to the present invention, the circuit is so arranged that the value $V_s$ is gradually decreased by the action of the resistor 162 and the switch 195, and the possibility of reversing the relationship of $V_o > V_s$ is extremely decreased, as compared with the feedback control system illustrated with reference to FIGS. 4 to 5C.

Figure 2A:
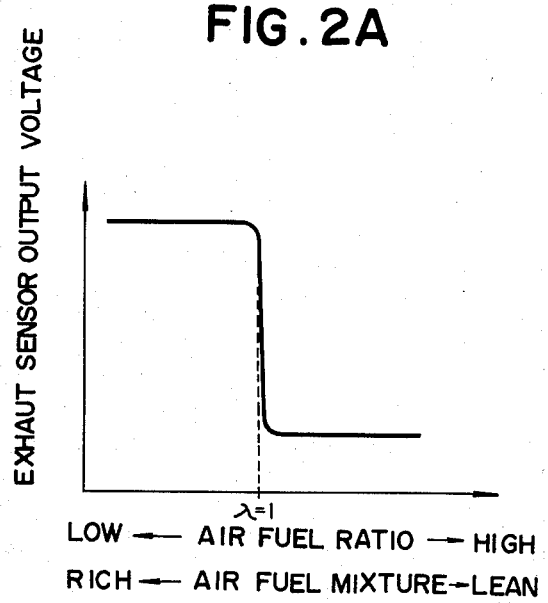
FIG. 2A is a graph showing the output characteristics of an exhaust sensor used in the system of FIG. 1.

Since the zirconia oxygen concentration detector has the characteristics shown in FIG. 2A, the value $V_o$ becomes higher when the air-fuel mixture to be supplied to the engine is rich. During stopping of feedback control due to lowering in coolant temperature, the air-fuel mixture becomes rich by the action of an increased amount of supplied fuel, so that the condition is usually $V_o > V_s$.

Figure 8:
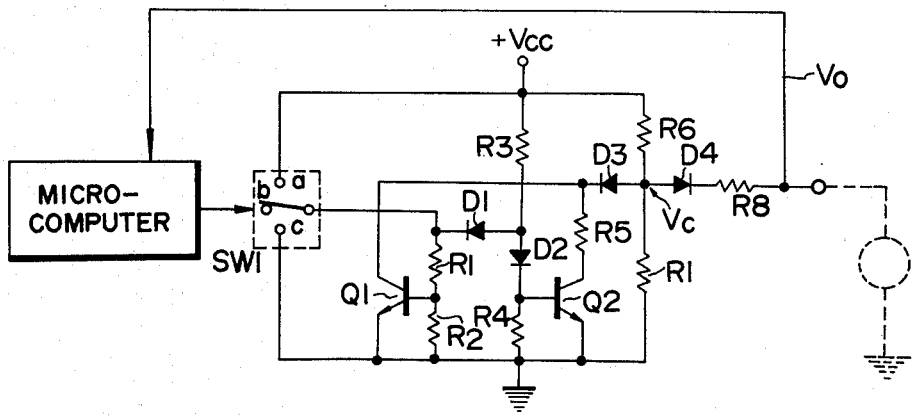
FIG. 8 is another circuit diagram of the feedback control section according to the present invention, used in the system of FIG. 1.

FIG. 8 shows a circuit of another embodiment of the present invention, which is controlled by using a microcomputer. In the circuit of FIG. 8, the operations of the various comparators and integrators used in the circuit of FIG. 6 are carried out using a program with the microcomputer, in which a circuit for supply a current flow to the exhaust sensor is realized by a hardware arrangement and its control is carried out by the program of the microcomputer.

Figure 9:
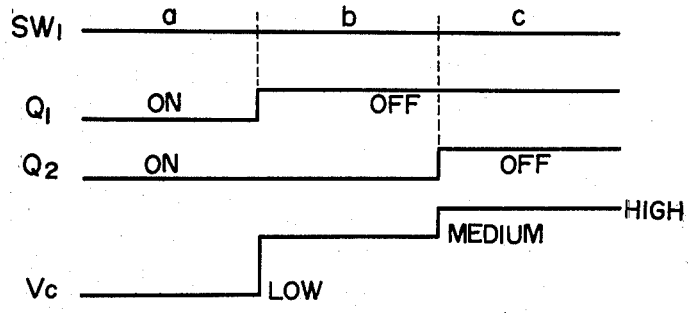
FIG. 9 is a timing chart showing an operation manner of the circuit diagram of FIG. 8.

In this case, the circuit for supplying a current flow to the exhaust sensor is not provided with the integrator (shown in FIG. 6) which can continuously vary the value of the electric current. Accordingly, the value of the current flow in this case is changed stepwise taking three steps in order to facilitate control with the microcomputer. The three steps correspond to a, b, and c in the state of a switch $SW_1$ as indicated in FIG. 9. In accordance with this, the voltage $V_c$ varies stepwise having three steps. It will be understood that the current flow i supplied to the exhaust sensor varies with the variation of the voltage $V_c$ stepwise having three steps of current flow, which are referred to as "low", "medium", and "high" in accordance with the order of the magnitude of the value $V_c$ as indicated in FIG. 9.

Figure 10:
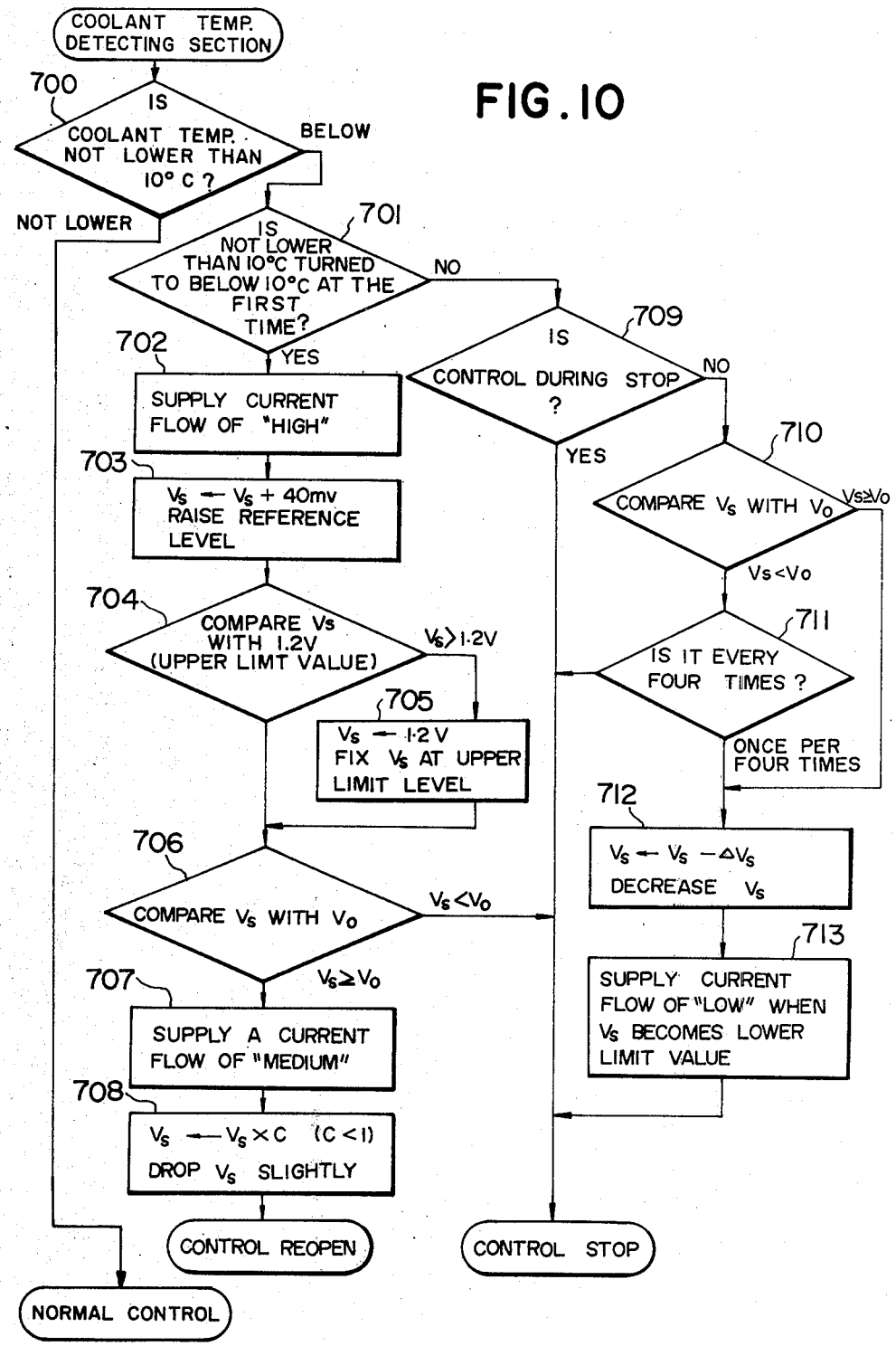
FIG. 10 is a flow chart explaining the operation of the circuit diagram of FIG. 8.

FIG. 10 shows an example of a program for accomplishing the control by detecting the warm-up condition of the exhaust sensor, which is achieved by supplying a current flow to the exhaust sensor using the circuit of FIG. 8. This program of FIG. 10 will be explained from a coolant temperature detection section for detecting the temperature of an engine coolant in a system where the fuel supply amount is corrected in response to an information from the exhaust sensor.

When the temperature of the engine coolant is not lower than a predetermined level such as 10° C., a normal control is carried out, i.e., the correction amount of fuel supply is computed in response to the relationship between the value $V_o$ of the exhaust sensor and the reference value $V_s$. When the coolant temperature is below the predetermined level, a step 700 leads to a step 701. The step 700 is supplied with a signal from the coolant temperature detecting section with a predetermined period, for example, in synchronism with engine speed. At a step 701, it is discriminated whether the coolant temperature has become below the predetermined level for the first time from the previous coolant temperature which is not lower than the predetermined level. Then, the step 701 leads to step 702 or 709. At steps after the step 702, the values $V_s$ and $V_o$ are so described as to make the states of $V_s$ and $V_o$ as indicated in FIGS. 7A to 7B. It is to be noted that the value $V_s$ has its upper limit in this case. During $V_s < V_o$, the control is stopped so that the correction amount is, for example, fixed at a previously decided value. If the condition becomes $V_s \geqq V_o$, the control is reopened. At this time, the current flow to the exhaust sensor becomes "medium" in FIG. 9.

When the step 701 leads to a step 709, it is discriminated whether the stopping of the control is caused by a monitor function or not, and then the value $V_s$ is decreased if the stopping of the control is not caused by the monitor function. The discrimination in the step 709 is carried out using the result which is obtained at another section of the program. The reference value $V_s$ is decreased in response to the relationship between $V_s$ and $V_o$ in a manner that the value $V_s$ decreases gradually when the condition is $V_s < V_o$ as compared with the condition $V_s \geqq V_o$. In FIG. 10, the decreasing rate when $V_s < V_o$ is one fourth of that when $V_s \geqq V_o$. It will be appreciated that the same function as in the circuit of FIG. 6 will be obtained by this program of FIG. 10.

Now, "control reopening" following a step 708 means the release of the stopping of the control due to the warm-up condition of the exhaust sensor. At this time, the coolant temperature is below 10° C. and accordingly the feedback control actually remains stopped since the stopping of the control due to the coolant temperature continues.

As appreciated from the foregoing explanation, according to the present invention, even during stopping of feedback control for the sake of engine temperature being low, the reference value $V_s$ is varied. Additionally, when the feedback control is stopped by the reason engine temperature being lowered during the feedback control, the warm-up condition of the exhaust sensor is detected by varying the reference value $V_s$ and the current flow i to the exhaust sensor. Therefore, the initiation of the feedback control is quickened and the apprehension of raising an erroneous control can be extremely decreased, which will improve exhaust emission control of an engine.

What is claimed is:

1. A system for controlling, in a feedback control mode, fuel supply to an internal combustion engine so as to maintain the air-fuel ratio of an air-fuel mixture to be supplied to the engine at a preset value by correcting a fuel supply amount in response to a control signal depending upon the deviation from a reference value of an output of an exhaust sensor for sensing the concentration of a component of engine exhaust gas, the improvement comprising:

first means for supplying a current flow to the exhaust sensor;

second means for varying said reference value in response to the output of said exhaust sensor;

third means for controlling the initiation and stop of the feedback control in accordance with the relationship between said reference value and the output of said exhaust sensor which output is generated in response to said current flow supplied to said exhaust sensor;

fourth means for controlling the initiation and stop of the feedback control in accordance with an engine temperature;

fifth means for varying said reference value and the value of said current flow to said exhaust sensor immediately when the feedback control is stopped by said fourth means; and sixth means for varying said reference value with the lapse of time while the feedback is stopped by said fourth means.

2. A system as claimed in claim 1, in which said fifth means includes means for raising said reference value and the value of said current flow to said exhaust sensor immediately when the feedback control is stopped by said fourth means.

3. A system as claimed in claim 2, in which said sixth means includes means for gradually dropping said reference value even during a first condition where the value of said output of said exhaust sensor is higher than said reference value.

4. A system as claimed in claim 3, in which said sixth means includes means for decreasing the dropping rate of said reference value during said first condition as compared with that during a second condition where the value of said output of said exhaust sensor is lower than said reference value.

5. A system as claimed in claim 1, in which said engine temperature is the temperature of an engine coolant.

6. A system as claimed in claim 5, in which said fourth means includes means for stopping the feedback control when the engine coolant temperature is below a predetermined level and initiating the feedback control when the engine coolant temperature is not lower than the predetermined level.

7. A system as claimed in claim 6, in which said predetermined level of the engine coolant temperature is 10° C.

8. A system for controlling in a feedback control mode the air-fuel ratio of an air-fuel mixture to be supplied to an internal combustion engine provided with an exhaust pipe, said system comprising:

an exhaust sensor operatively disposed in said exhaust pipe to sense the concentration of a component of exhaust gas from said engine and to produce an information output signal;

means for deciding a basic fuel supply amount to the engine in accordance with an engine operating parameter;

means for correcting said basic fuel supply amount in response to a control signal depending upon the deviation from a reference value of the value of said information output signal so as to maintain the air-fuel ratio of the air-fuel mixture at a preset value;

means for supplying a current flow to said exhaust sensor;

means for varying said reference value in response to the information output signal of said exhaust sensor;

means for controlling the initiation and stop of the feedback control in accordance with the relationship between said reference value and the information output signal of said exhaust sensor which output signal is generated in response to said current flow supplied to said exhaust sensor;

means for controlling the initiation and stop of the feedback control in accordance with an engine temperature;

means for varying said reference value and the value of said current flow to said exhaust sensor immediately when the feedback control is stopped in response to said engine temperature; and means for varying said reference value with lapse of time while the feedback control is stopped in response to said engine temperature.

9. An internal combustion engine having an exhaust pipe, comprising:

an exhaust sensor operatively disposed in said exhaust pipe to sense the concentration of a component of engine exhaust gas passing through the exhaust pipe to produce an information output signal;

an exhaust gas purifying device disposed in the exhaust pipe to purify the exhaust gas passing through the exhaust pipe;

means for deciding a basic fuel supply amount to the engine in accordance with engine operating parameters;

means for correcting said basic fuel supply amount in response to a control signal depending upon the deviation between an reference value and the value of said information output signal so as to maintain the air-fuel ratio of mixture at a preset value;

means for supplying a current flow to said exhaust sensor;

means for varying said reference value in response to the information output signal to said exhaust sensor;

means for controlling the initiation and stop of the feedback control in accordance with the relationship between said reference value and the value of said information output signal of said exhaust sensor which output signal is generated in response to said current flow supplied to said exhaust sensor;

means for controlling the initiation and stop of the feedback control in accordance with engine temperature;

means for varying said reference value and the value of said current flow to said exhaust sensor immediately when the feedback control is stopped in response to said engine temperature;

means for varying said reference value with the lapse of time while the feedback control is stopped in response to said engine temperature.

10. An internal combustion engine as claimed in claim 9, in which said exhaust gas purifying device is a three-way catalytic converter which functions to oxidize CO and HC and reduce $NO_x$.

11. An internal combustion engine as claimed in claim 10, in which said preset value of the air-fuel ratio is stoichiometric air-fuel ratio.

12. An internal combustion engine as claimed in claim 11, in which said exhaust sensor is an oxygen sensor for sensing the concentration of oxygen contained in the exhaust gas passing through the exhaust pipe.

13. A method for controlling in a feedback control mode fuel supply to internal combustion engine so as to maintain the air-fuel ratio of an air-fuel mixture to be supplied to the engine at a preset value by correcting the fuel supply amount in response to a control signal depending upon the deviation from a reference value of an output of an exhaust sensor for sensing the concentration of a component of engine exhaust gas, the improvement comprising the steps of:

supplying a current supply to said exhaust sensor;

varying said reference value in response to the output of said exhaust sensor;

controlling the initiation and stop of the feedback control in accordance with the relationship between said reference value and the output of said exhaust sensor which output is generated in response to said current flow supplied to said exhaust sensor;

controlling the initiation and stop of feedback control in accordance with an engine temperature;

varying said reference value and the value of said current flow to said exhaust sensor immediately when the feedback control is stopped in response to said engine temperature; and varying said reference value with the lapse of time while the feedback control is stopped in response to said engine.

14. A method for controlling in a feedback control mode the air-fuel ratio of an air-fuel mixture to be supplied to an internal combustion engine provided with an exhaust pipe in which an exhaust sensor is disposed to sense the concentration of a component of engine exhaust gas to produce an information output signal, comprising:

deciding a basic fuel supply amount to the engine in accordance with an engine operating parameter;

correcting said basic fuel supply amount in response to a control signal depending upon the deviation from a reference value of the value of said information output signal so as to maintain the air-fuel ratio of the air-fuel mixture at a preset value, supplying a current flow to said exhaust sensor;

varying said reference value in response to the information output signal of said exhaust sensor, controlling the initiation and stop of the feedback control in accordance with the relationship between said reference value and generating the information output signal of said exhaust sensor output in response to said current flow supplied to said exhaust sensor;

controlling the initiation and stop of the feedback control in accordance with an engine temperature;

varying said reference value and the value of said current flow to said exhaust sensor immediately when the feedback control is stopped in response to said engine temperature; and varying said reference value with the lapse of time while the feedback control is stopped in response to engine temperature.

* * * * *